US006260694B1

(12) United States Patent
Sasahara

(10) Patent No.: US 6,260,694 B1
(45) Date of Patent: Jul. 17, 2001

(54) FOOD AND DRINK CIRCULATING CONVEYER PASSAGE PROVIDED WITH OPENING AND CLOSING DOORS

(75) Inventor: Shintaro Sasahara, Turugi-machi (JP)

(73) Assignee: Ishino Seisakusyo Co., Inc., Ishikawa-Ken (JP)

( * ) Notice: Subject to any disclaimer, the term of this patent is extended or adjusted under 35 U.S.C. 154(b) by 0 days.

(21) Appl. No.: 09/175,931

(22) Filed: Oct. 20, 1998

(30) Foreign Application Priority Data

Nov. 19, 1997 (JP) ..... 9-344900

(51) Int. Cl.[7] ..... B65G 21/00

(52) U.S. Cl. ..... 198/860.4; 198/860.3; 198/860.5

(58) Field of Search ..... 198/860.3, 860.4, 198/860.5, 735.1, 735.2, 735.3, 735.4, 735.5; 186/49; 312/138.1

(56) References Cited

U.S. PATENT DOCUMENTS

| | | | | |
|---|---|---|---|---|
| 3,856,135 | * | 12/1974 | Hayakawa et al. | 198/860.5 |
| 4,093,066 | * | 6/1978 | Mitchell et al. | 198/860.5 |
| 4,170,293 | * | 10/1979 | Campbell | 198/860.4 |
| 4,807,312 | * | 2/1989 | Braus | 4/607 |
| 4,812,701 | * | 3/1989 | Izumi | 312/285 |

FOREIGN PATENT DOCUMENTS

| | | | | |
|---|---|---|---|---|
| 8238159 | | 9/1996 | (JP) | A47G/23/08 |
| 937914 | | 2/1997 | (JP) | A47G/23/08 |
| 970347 | | 3/1997 | (JP) | A47G/23/08 |
| 9189792 | | 7/1997 | (JP) | G21C/17/06 |
| 9238810 | | 9/1997 | (JP) | A47G/23/08 |
| 1071065 | | 3/1998 | (JP) | A47F/10/06 |
| 10-85115 | * | 4/1998 | (JP) . | |
| 1085115 | | 4/1998 | (JP) | A47G/23/08 |
| 10295521 | * | 11/1998 | (JP) . | |

* cited by examiner

*Primary Examiner*—Robert P. Olszewski
*Assistant Examiner*—Steven B. McAllister
(74) *Attorney, Agent, or Firm*—Hayes, Soloway, Hennessey, Grossman & Hage, PC

(57) ABSTRACT

In a food and drink circulating conveyer passage 1 disposed along an eating and drinking counter 3 for conveying and supplying food and drink, a tunnel unit 5 which has at least one side formed to a curved portion having a prescribed radius of curvature is disposed on the conveyer passage and slide rails 10 are disposed to guide the opening and closing doors along the curved portion in an up and down direction, wherein when the opening and closing doors have been moved to an upper position of the tunnel unit, they are disengaged from the slide rails and can be removed from the tunnel unit.

4 Claims, 7 Drawing Sheets

FOOD AND DRINK CIRCULATING CONVEYER PASSAGE PROVIDED WITH OPENING AND CLOSING DOORS

BACKGROUND OF THE INVENTION

1. Field of the Invention

The present invention relates to a circulating type conveyer passage disposed along an eating and drinking counter for conveying food and drink, and more specifically, to a food and drink circulating conveyer passage provided with opening and closing doors for preventing food on the conveyer passage from becoming dry and foreign matters from depositing on the food.

2. Description of the Related Art

There have been widely used circulating type eating and drinking counters provided with an endless circulating type food conveyer passage disposed along the counter for conveying vessels placed thereon such as plates and the like in which commodities, for example, food and drink such as "sushi" and the like are served because customers can eat and drink and cooks can cook without the need of movement and further the customers can eat and drink while selecting desired commodities at their seats.

In the eating and drinking counters arranged as described above, there is a distance from a kitchen from which food such as sushi and the like as a commodity is charged to a place where the customers exist as well as there is a possibility that the food becomes dry and foreign matters such as dusts and insects are deposited thereon because the conveyer passage circulates. To cope with this problem, there is employed a method of conveying the vessels such as the plates and the like by covering them with upset-bowl-shaped lid members. In this case, the customers eat and drink by taking out the vessels in which food is served from the conveyer passage together with the lid members and placing them on the counter.

However, the method of using the lid member is troublesome because the customers must remove the lid members from the vessels each time they eat and drink and the removed lid members are obstructive to eating. Further, since the lid members must be washed when necessary likewise the vessels, a lot of manpower and a considerable cost are necessary to wash them as well as since the lid member must be placed on the vessel when food is charged onto the conveyer passage, a troublesome job is required by it.

To solve the above problem, there has been recently proposed a method of conveying food and drink on a conveyer passage by shutting off them from the outside by providing a cover member for entirely covering the upper portion of the conveyer passage and permitting customers to eat and drink desired food and drink by taking out them through opening/closing portions formed to the cover member.

The cover member, however, must be periodically cleaned and washed to keep it sanitary because stains, foreign matters and the like are deposited thereon when it is used. Since, however, the conventional cover member is fixed or even if it is arranged to be removable, it is troublesome to remove the cover member, there is a problem that it is difficult to execute maintenance of the cover member such as cleaning, washing and the like.

When the cover member is arranged to be removable, there is a possibility that it is removed by a customer when he or she opens or closes an opening/closing portion, if an excessive force is applied thereto at the time. Thus, there is a problem that when the cover member is composed of glass or the like, it may be broken if it is carelessly removed and this is dangerous to the customer.

Further, since the cover member is composed of a transparent material such as, for example, acryl, glass or the like so that food and drink which is being conveyed can be visually confirmed from the outside, there is a problem that when the transparent material is transported by being equipped with a conveyer passage, the transparent material is liable to be scratched.

An object of the present invention made in view of the above problems is to provide a food and drink circulating conveyer passage provided with opening and closing doors, the conveyer passage being arranged such that maintenance such as washing and cleaning can be easily carried out to it, there is not a possibility that a cover member and the like are carelessly removed and they are not scratched while transported.

SUMMARY OF THE INVENTION

To solve the above problem, a food and drink circulating conveyer passage of the present invention provided with opening and closing doors and disposed along an eating and drinking counter for conveying and supplying food and drink is characterized by comprising a tunnel unit which has at least one side formed to a curved portion having a prescribed radius of curvature and is disposed on the conveyer passage and slide rails for guiding the opening and closing doors along the curved portion in an up and down direction, wherein when the opening and closing doors have been moved to an upper position of the tunnel unit, they are disengaged from the slide rails and can be removed from the tunnel unit.

According to the characteristic, since the openable and closable opening and closing doors can be removed at the upper position of the tunnel unit which is beyond the positions to which the doors are moved in an ordinary opening and closing operation, the opening and closing doors can be easily removed as well as maintenance for cleaning and washing the tunnel unit can be easily carried out.

Further, since the opening and closing doors are not disengaged from the slide rails so long as they are not moved beyond the ordinary opening and closing positions, when a customer opens and closes an opening and closing door, it is not carelessly removed, whereby safety is assured and the opening and closing doors are not scratched.

A food and drink circulating conveyer passage of the present invention provided with opening and closing doors is preferably arranged such that each of the slide rails is composed of an outside guide and an inside guide and the outside guide is not formed to the upper position of the tunnel unit.

With this arrangement, there can be simply realized a mechanism capable of preventing the opening and closing doors from being disengaged from the slide rails at the ordinary opening and closing positions and easily removing the opening and closing doors at the upper position of the tunnel unit where the outside guides of the slide rails are not provided by easily disengaging the opening and closing doors from the slide rails, even if the mechanism is composed of a smaller number of parts.

A food and drink circulating conveyer passage of the present invention provided with opening and closing doors is preferably arranged such that removable lid members having a radius or curvature approximately the same as that of the curved portion are placed to the upper position of the tunnel unit and the inside surfaces of the lid members serve as external guides for guiding the opening and closing doors.

With this arrangement, since the opening and closing doors are guided from the outside and inside thereof at all times regardless of that a simple structure is employed to them, the opening and closing doors can be smoothly opened and closed.

A food and drink circulating conveyer passage of the present invention provided with opening and closing doors is preferably arranged such that a grip projecting toward the outside of the tunnel unit is disposed to each of the opening and closing doors and engaged with each of the lid members to thereby prevent the opening and closing doors from sliding more than a predetermined amount.

With this arrangement, a mechanism for preventing the movement of the opening and closing doors more than a prescribed amount can be easily provided as well as it can be also prevented that the opening and closing doors are removed by being moved more than the prescribed amount.

A food and drink circulating conveyer passage of the present invention provided with opening and closing doors is preferably arranged such that a thin polyolefin layer is formed to each of the portions of the opening and closing doors which are in contact with the slide rails.

With this arrangement, the opening and closing doors can be smoothly opened and closed as well as the occurrence of noise can be prevented when they are opened and closed.

A food and drink circulating conveyer passage of the present invention provided with opening and closing doors is preferably arranged such that a supporting member having the slide rails for guiding the opening and closing doors is arranged as a plurality of units each having a prescribed length which are sequentially engaged with engaging grooves formed to a housing unit and the opening and closing doors are assembled to the plurality of units to thereby form the tunnel unit horizontally and continuously.

With this arrangement, since the tunnel unit is divided into the plurality of units each having the prescribed length, the tunnel unit can be easily transported. Further, the tunnel unit can be easily assembled horizontally and continuously only by engaging the respective divided units with the engaging grooves formed to a housing unit.

DESCRIPTION OF THE PREFERRED EMBODIMENT

An embodiment of the present invention will be described below based on the drawings.

Figure 1:
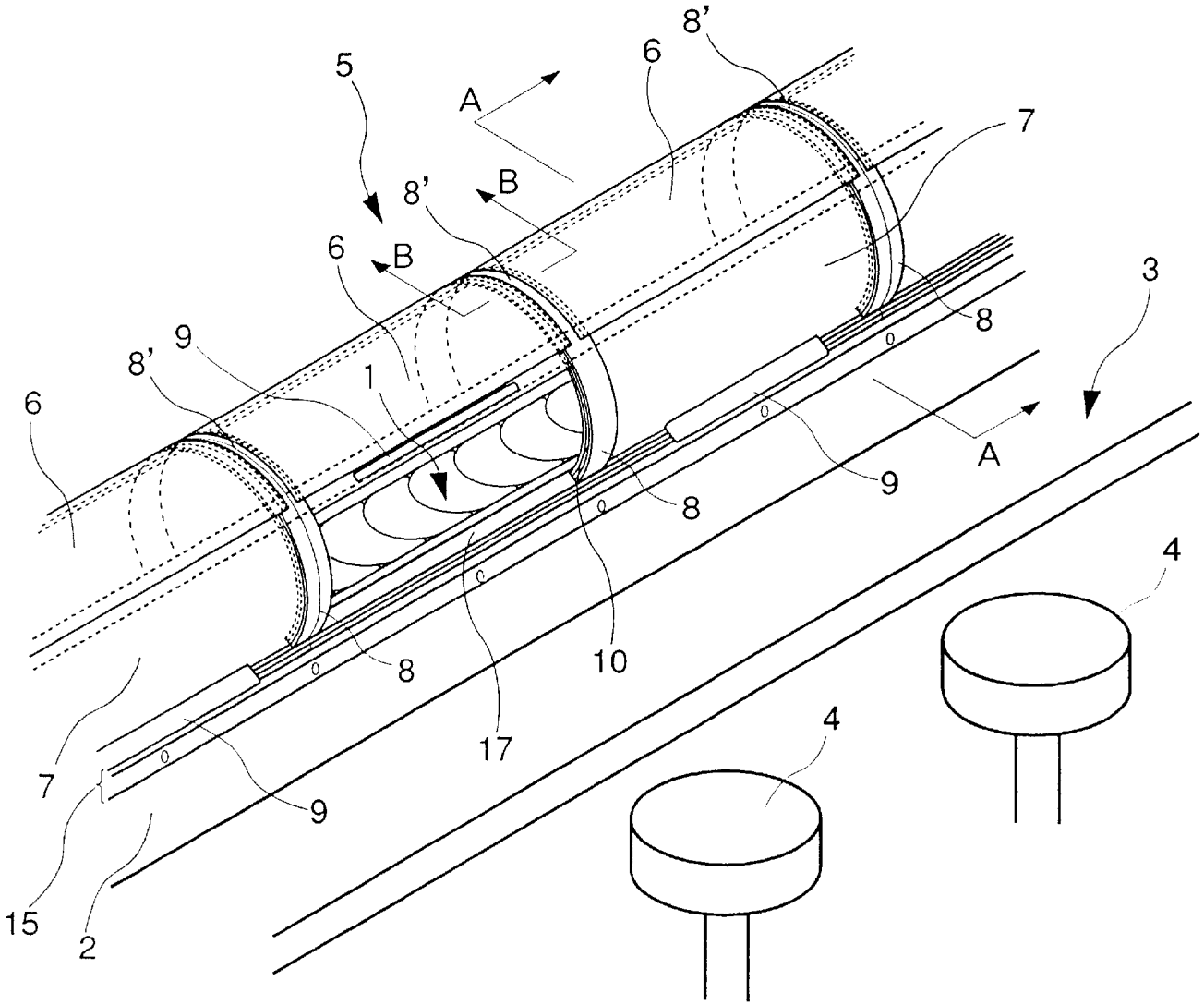
FIG. 1 is an outside perspective view showing a food and drink circulating conveyer passage provided with opening and closing doors in an embodiment of the present invention.
Figure 2A:
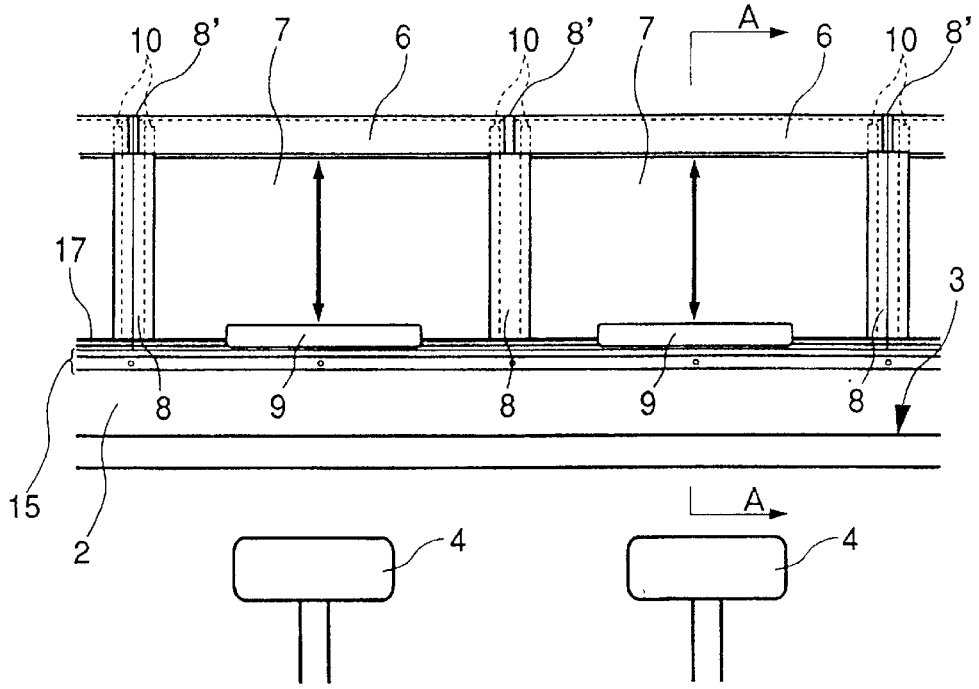
FIG. 2A is a front elevational view showing the food and drink circulating conveyer passage provided with the opening and closing doors in the embodiment of the present invention.
Figure 2B:
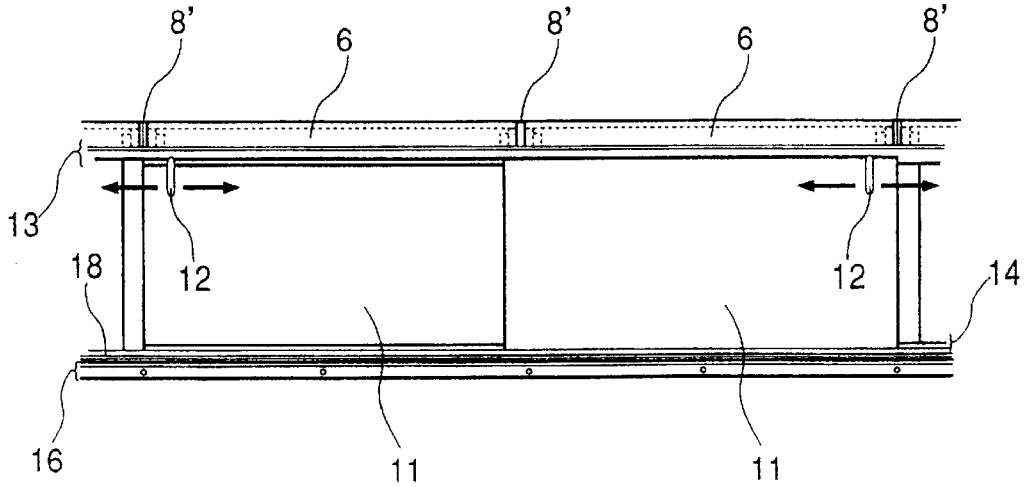
FIG. 2B is a rear elevational view showing the food and drink circulating conveyer passage provided with the opening and closing doors in the embodiment of the present invention.
Figure 3A:
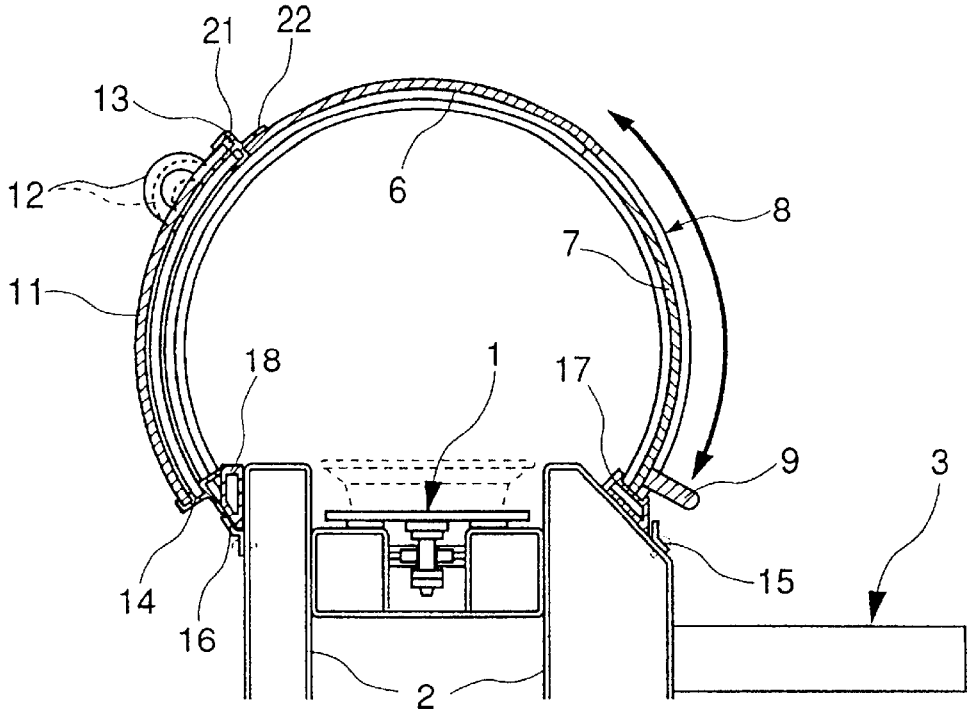
FIG. 3A is a sectional view taken along the section A—A in FIG. 1 of the food and drink circulating conveyer passage provided with the opening and closing doors in the embodiment of the present invention.
Figure 3B:
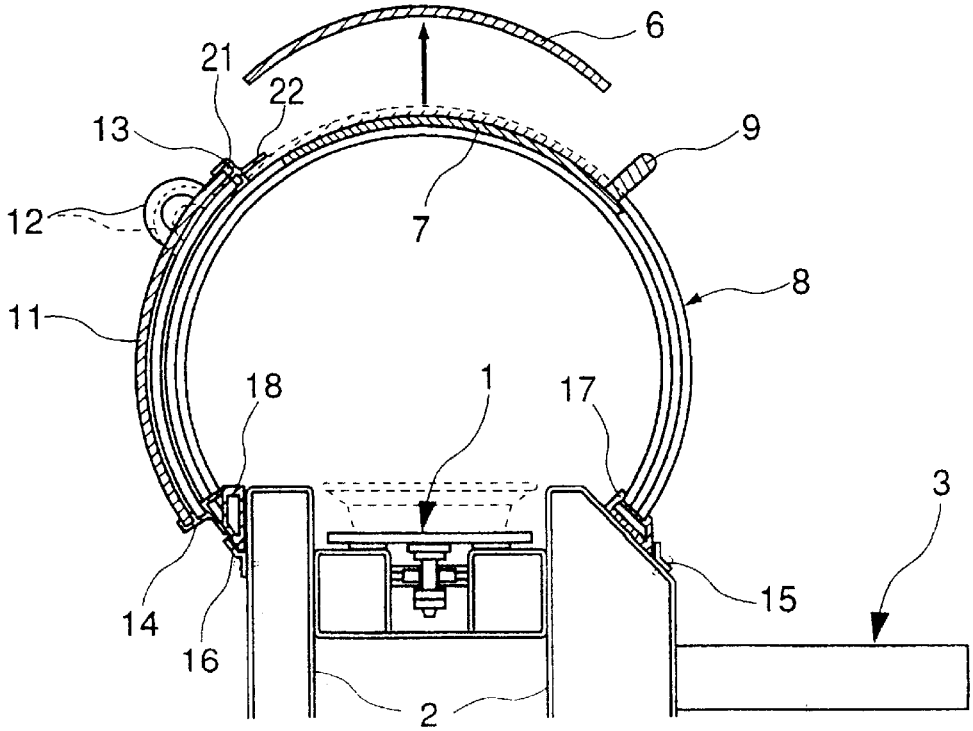
FIG. 3B is a sectional view showing a state that an opening and closing door is removed from the food and drink circulating conveyer passage provided with the opening and closing doors in the embodiment of the present invention.
Figure 4A:
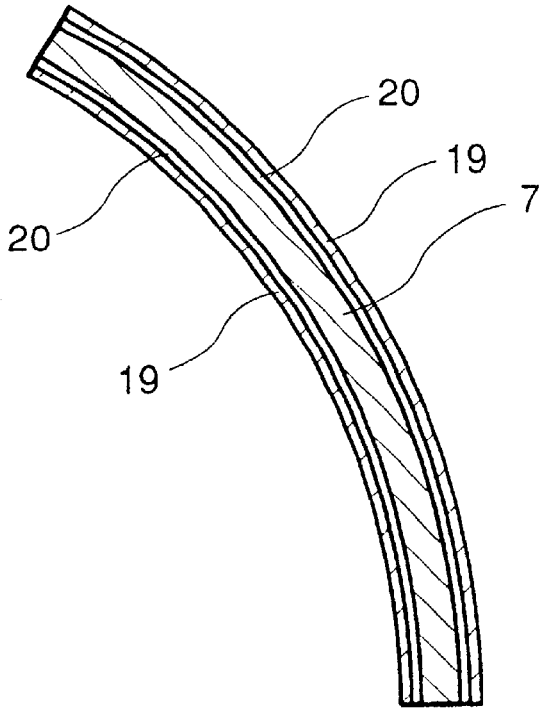
FIG. 4A is a sectional view showing an arrangement of a customer's opening and closing door used to the food and drink circulating conveyer passage provided with the opening and closing doors in the embodiment of the present invention.
Figure 4B:
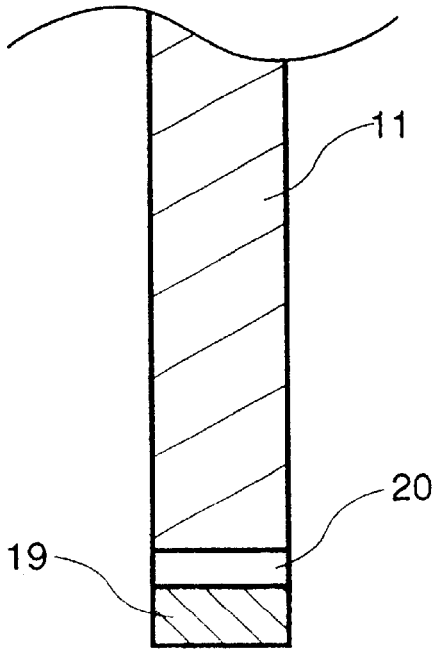
FIG. 4B is a sectional view showing an arrangement of a cook's opening and closing door used to the food and drink circulating conveyer passage provided with the opening and closing doors in the embodiment of the present invention.
Figure 5:
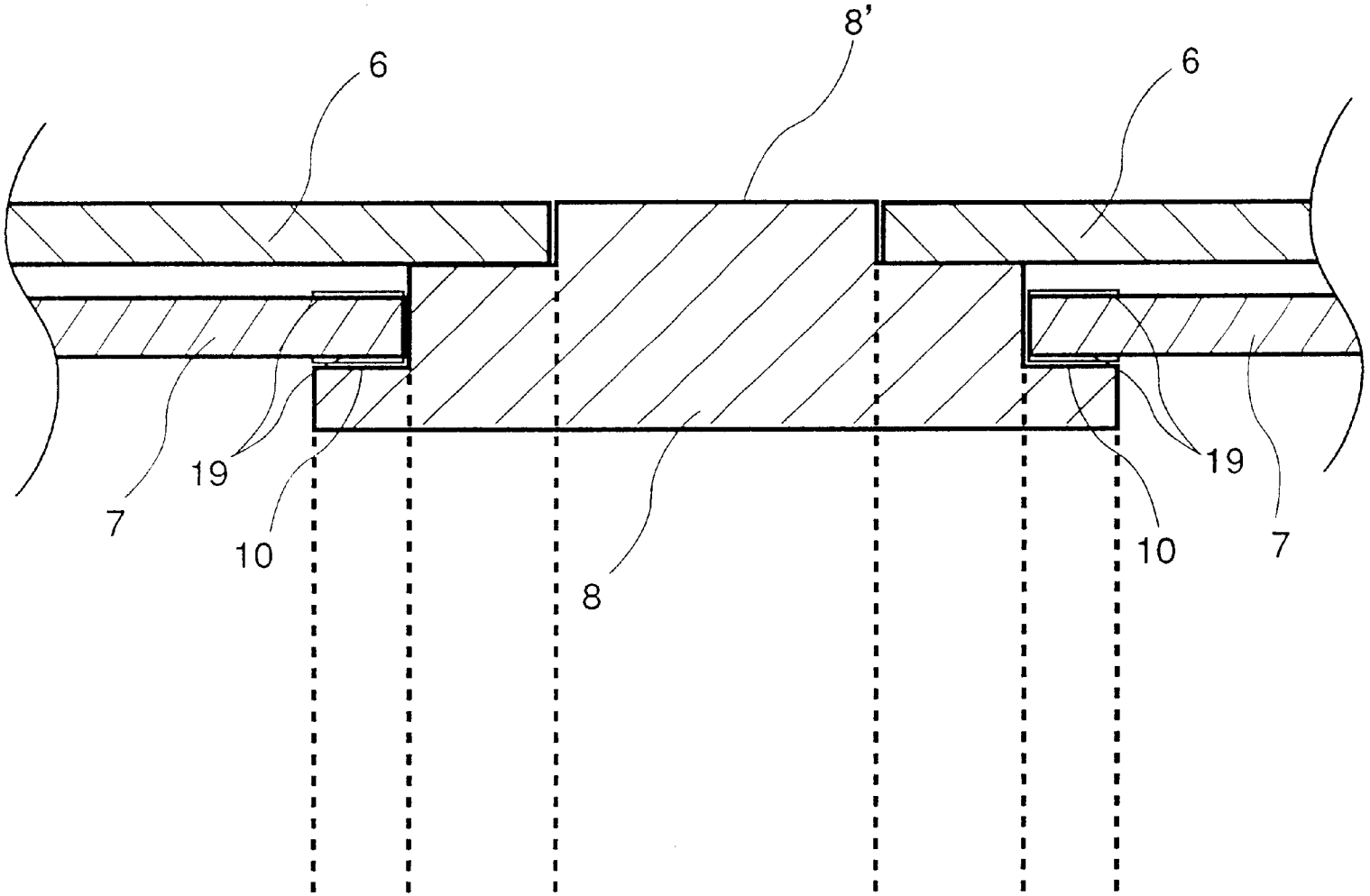
FIG. 5 is a sectional view of a support column taken along the section B—B in FIG. 1 which is used to the food and drink circulating conveyer passage provided with the opening and closing door in the embodiment of the present invention.
Figure 6:
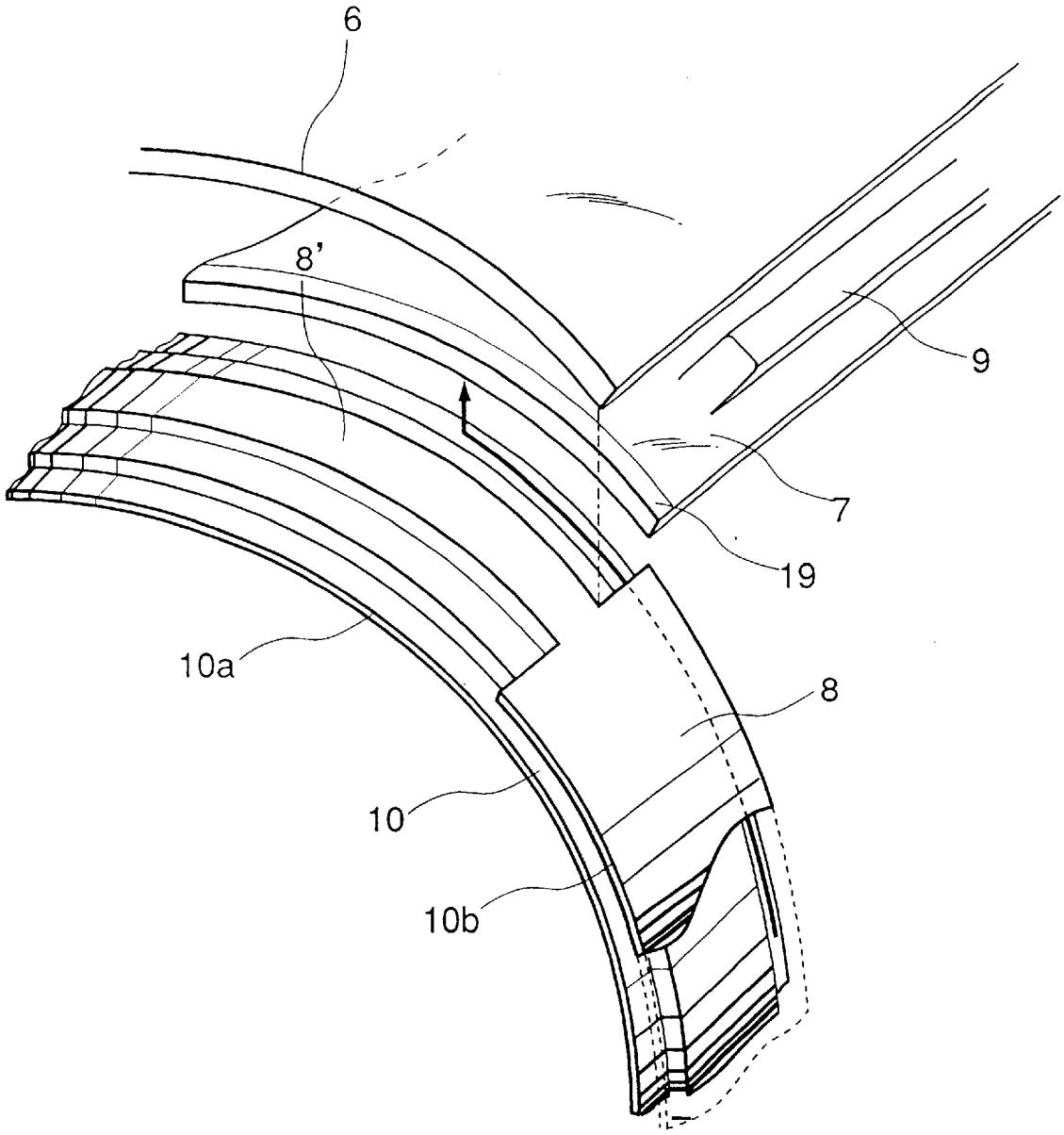
FIG. 6 is a perspective view showing a state that an opening and closing door is removed from the food and drink circulating conveyer passage provided with the opening and closing doors in the embodiment of the present invention.

FIG. 1 is an outside perspective view showing a food and drink circulating conveyer passage provided with opening and closing doors in an embodiment of the present invention, FIG. 2A is a front elevational view showing the food and drink circulating conveyer passage provided with the opening and closing doors in the embodiment of the present invention, FIG. 2B is a rear elevational view showing the food and drink circulating conveyer passage provided with the opening and closing doors in the embodiment of the present invention, FIG. 3A is a sectional view taken along the section A—A in FIG. 1 of the food and drink circulating conveyer passage provided with the opening and closing doors in the embodiment of the present invention, FIG. 3B is a sectional view showing a state that an opening and closing door is removed from the food and drink circulating conveyer passage provided with the opening and closing doors in the embodiment of the present invention, FIG. 4A is a sectional view showing an arrangement of a customer's opening and closing door used to the food and drink circulating conveyer passage provided with the opening and closing doors in the embodiment of the present invention, FIG. 4B is a sectional view showing an arrangement of a cook's opening and closing door used to the food and drink circulating conveyer passage provided with the opening and closing doors in the embodiment of the present invention, FIG. 5 is a sectional view of a support column taken along the section B—B in FIG. 1 which is used to the food and drink circulating conveyer passage provided with the opening and closing door in the embodiment of the present invention and FIG. 6 is a perspective view showing a state that an opening and closing door is removed from the food and drink circulating conveyer passage provided with the opening and closing doors in the embodiment of the present invention.

As shown in FIG. 1, FIG. 2 and FIG. 3, the food and drink circulating conveyer passage provided with the opening and closing doors of the embodiment comprises a flat top chain conveyer 1 disposed along an eating and drinking counter 3 and serving as a circulating conveyer passage for conveying sushi and the like as food and drink placed on sushi plates, a conveyer housing 2 disposed on both the sides of the flat top chain conveyer 1, and a substantially cylindrical tunnel unit 5 formed continuously above the flat top chain conveyer 1 so as to cover the upper surface of the conveyer housing 2.

As shown in FIG. 2A, FIG. 2B and FIG. 3A, the substantially cylindrical tunnel unit 5 comprises customer's opening and closing doors 7 which form the side of the tunnel portion 5 confronting the eating and drinking counter 3 and are arranged slidably movably upward and downward and opened and closed by customers, a ceiling plate 6 forming the upper portion of the tunnel portion 5, cook's opening and closing doors 11 which form the side of the tunnel portion 5 opposite to the above side formed by the customer's opening and closing doors 7 and are slidingly movable in a horizontal direction and opened and closed by cooks and the like, supporting columns 8 which support the customer's opening and closing doors 7 and the ceiling plate 6 as well as an upper lateral slide rail 13 for supporting the cook's opening and closing doors 11 and are provided with slide rails 10 along which the customer's opening and closing doors 7 are slidingly moved and base rails 17, 18 on which the supporting columns 8 are disposed at prescribed intervals.

The customer's opening and closing doors 7, the ceiling plate 6 and the cook's opening and closing doors 11 are made of transparent acryl resins each molded to have a prescribed radius of curvature so that various types of sushi conveyed on the flat top chain conveyer 1 can be visually confirmed by the customers and the cooks. Grips 9, 12 are attached to the customer's opening and closing doors 7 and the cook's opening and closing doors 11 so that these doors can be opened and closed through them. The customer's opening and closing door 7 can be opened and closed in such a manner that it is engaged with the slide rails 10 disposed to the supporting columns 8 and each composed of an inside guide 10*a* and an outside guide 10*b* and slidingly moved upward and downward. Whereas, the cook's opening and closing door 11 can be opened and closed in such a manner that it is engaged with the upper lateral slide rail 13 and a lower lateral slide rail 14 and moved in a horizontal direction.

As shown in FIG. 4A, a "PO tape" (commodity name of OAK Co., Ltd, USA) which is composed of an ultrahigh molecular weight polyethylene resin 19 and formed to a film of a prescribed thickness with an adhesive layer 20 formed to one surface thereof is bonded to each of the portions of the customer's opening and closing door 7 which are engaged with and abutted against the slide rails 10 so that the door 7 can be smoothly opened and closed and the occurrence of noise can be prevented by reducing the frictional resistance of the door 7 to the slide rails 10. Likewise, the "PO tape" is also bonded to the lower portion of the cook's opening and closing door 11 which is abutted against the lateral slide rail 14 as shown in FIG. 4B.

The supporting column 8 is composed of an aluminum material and mounted on the base rails 17, 18 so as to be perpendicular thereto at prescribed intervals. In the embodiment, each of the base rails 17, 18 is divided into a plurality of units each corresponding to 2 spans having a prescribed length, whereby the base rails 17, 18 can be unitized. Guide rails 15, 16 are disposed to the conveyer housing 2 in each unit and engaged with the base rails 17, 18 so that the respective units can be located at positions where they can be automatically connected to each other. The interiors of the base rails 17, 18 are made empty and the base rails 17, 18 of the respective units are integrally engaged with each other at connecting portions so that the empty portions thereof are continuously connected to thereby easily form a continuous tunnel.

In the embodiment, when the customer's opening and closing door 7 is slidingly moved to a prescribed upper position, the grip 9 disposed to the door 7 is engaged with the ceiling 6 so that the customer's opening and closing doors 7 is stopped at the prescribed position. Further, when a customer releases his or her hand from the grip 9 after he or she opens the customer's opening and closing door 7 and takes out a sushi, the customer's opening and closing doors 7 automatically returns to its original position by the weight of the grip 9 so that the door 7 is closed.

The customer's opening and closing doors 7, the ceiling plate 6 and the cook's opening and closing doors 11 which constitute the tunnel unit 5 of the embodiment are arranged to be removable. A method of removing them will be described below based on FIG. 3B and FIG. 6. The cook's opening and closing door 11 has a prescribed size to permit a gap 21 to be formed between the cook's opening and closing door 11 and the upper lateral slide rail 13. Accordingly, when the cook's opening and closing door 11 is lifted upward, the door 11 is disengaged from the lower lateral slide rail 14 and can be removed likewise an ordinary laterally sliding door.

Further, the upper oblique movement of the ceiling plate 6 permits it from being disengaged from a claw portion 22 disposed to the upper lateral slide rail 13 so that the ceiling plate 6 can be easily removed. When the ceiling plate 6 is removed, the customer's opening and closing door 7 can be moved upward beyond the positions to which the door 7 is moved when it is opened or closed as shown in FIG. 6. As apparent from the cross section of the supporting column 8 shown in FIG. 5, there is no outside guide 10*b* constituting the slide rails 10 at an upper position so that the customer's opening and closing doors 7 can be taken out from the slide rails 10 upward by removing the ceiling plate 6.

With the arrangement of the embodiment, since the customer's opening and closing door 7 is reliably engaged with the slide rails 10 at a position where the customer opens and closes the door 7, it is not easily removed even if the customer applies an excessive force thereto as well as the customer's opening and closing doors 7 can be easily removed by moving it beyond the positions to which it is moved in the opening and closing operation thereof. Since the cook's opening and closing door 11 can be also removed in the embodiment, these respective components can be washed and cleaned in a removed state as well as maintenance and cleaning of the conveyer passage can be carried out in the removed state, whereby the workability of a maintenance job can be improved.

Since all of the customer's opening and closing doors 7, the ceiling plate 6 and the cook's opening and closing doors 11 which constitute the transparent portion of the tunnel unit 5 can be easily mounted and dismounted in the embodiment, the tunnel unit 5 can be transported in a state that the transparent components are removed therefrom and they can be mounted to the tunnel unit 5 when it is installed, whereby the transparent components can be prevented from being scratched when they are transported and installed.

Further, since the tunnel unit 5 is divided into the plurality of units each having the prescribed length in the embodiment, it can be easily transported. When the respective units are assembled, they can be easily located at the positions where they are connected to each other by means of the guide rails 15, 16.

Figure 7A:
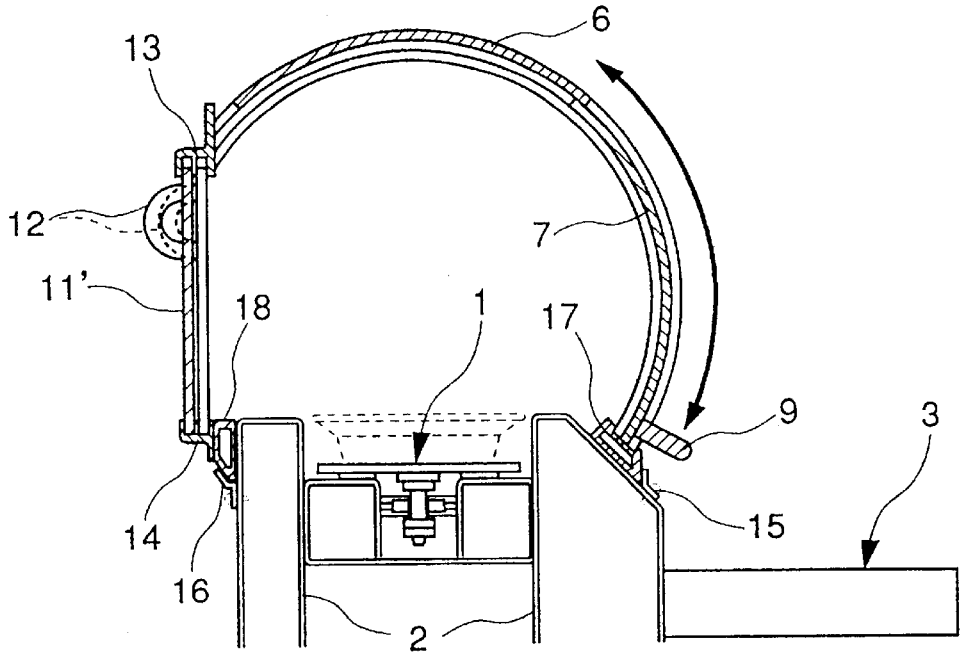
FIG. 7A is a sectional view showing a configuration embodying the embodiment of the present invention.
Figure 7B:
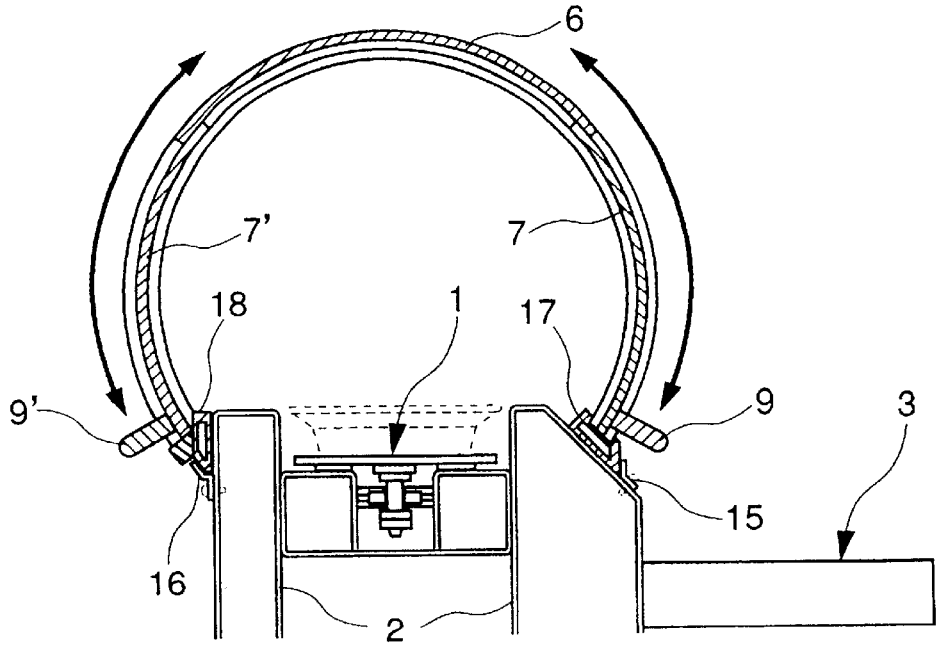
FIG. 7B is a sectional view showing a configuration embodying the embodiment of the present invention.

While the embodiment has been described based on the drawings, the present invention is by no means limited thereto and it goes without saying that any modification and addition made in a range which does not depart from the gist of the present invention can be included in the present invention. For example, the shape and arrangement of the tunnel unit 5 may be formed as shown in FIG. 7A by replacing the cook's opening and closing door 11 with a flat cook's opening and closing door 11' or as shown in FIG. 7B by replacing it with a cook's opening and closing door 7' which can be opened and closed in an up and down direction likewise the customer's opening and closing door 7.

Although the transparent portion constituting the tunnel unit 5 is formed by molding the acryl resin in the embodiment, the present invention is not limited thereto and other transparent material, for example, glass or other resins having high transparency such as polycarbonate, etc. may be used and the material may be suitably selected depending upon the shape, workability and the like thereof.

While the ceiling plate 6 is made unmovable in the embodiment, it may be made horizontally movable by removing partitions 8' on the upper surface of the supporting column 8.

Although the "PO tapes" are bonded to the portions of the respective doors which are engaged with the slide rails, the present invention is not limited thereto and these polyolefin layers, in particular, the ultrahigh molecular weight polyethylene layers may be formed to the portions of the respective slide rails which are in contact with the respective doors. Although the ultrahigh molecular weight polyethylene is preferable because it reduces friction as well as is less worn and its effect is maintained for a long time, polyolefin other than the ultrahigh molecular weight polyethylene of the embodiment, for example, high density propylene, etc. may be used.

Although the aluminum material is used to the supporting column 8 and base rails 17, 18 which constitute the tunnel unit 5 in the embodiment, the present invention is not limited thereto and other material, for example, a material excellent in a corrosion resistance such as stainless steel, resin, etc. may be used.

An ultraviolet ray absorbing layer for absorbing ultraviolet rays, for example, a polycarbonate layer, an anti-fog layer, for example, an interfacial active agent layer for preventing the fog formed to the inside of the tunnel by the humidity therein, a reflection preventing layer composed of a reflection preventing film having a thickness approximately half the wavelength of visible light for preventing the interior of the tunnel from being made difficult to see by the irregular reflection of the light by weakening the irregularly reflected light, and the like may be arbitrarily formed to the surface of the transparent acryl resin.

Further, since the formation of the tunnel as shown in the embodiment increases the airtightness in the tunnel, the interior of the tunnel may be humidified or cooled to prevent the food therein from being dried and corroded.

The present invention will achieve the following advantages.

(a) Since the openable and closable opening and closing doors can be removed at the upper position of the tunnel unit which is beyond the positions to which the doors are moved in an ordinary opening and closing operation, the opening and closing doors can be easily removed as well as maintenance for cleaning and washing the tunnel unit can be easily carried out.

Further, since the opening and closing doors are not disengaged from the slide rails so long as they are not moved beyond the ordinary opening and closing positions, when a customer opens and closes an opening and closing door, it is not carelessly removed, whereby safety is assured and the opening and closing doors are not scratched.

(b) There can be simply realized a mechanism capable of preventing the opening and closing doors from being disengaged from the slide rails at the ordinary opening and closing positions and easily removing the opening and closing doors at the upper position of the tunnel unit where the outside guides of the slide rails are not provided by easily disengaging the opening and closing doors from the slide rails, even if the mechanism is composed of a smaller number of parts.

(c) Since the opening and closing doors are guided from the outside and inside thereof at all times regardless of that a simple structure is employed to them, the opening and closing doors can be smoothly opened and closed.

(d) A mechanism for preventing the movement of the opening and closing doors more than a prescribed amount can be easily provided as well as it can be also prevented that the opening and closing doors are removed by being moved more than the prescribed amount.

(e) Opening and closing doors can be smoothly opened and closed as well as the occurrence of noise can be prevented when they are opened and closed.

(f) Since the tunnel unit is divided into the plurality of units each having the prescribed length, the tunnel unit can be easily transported. Further, the tunnel unit can be easily assembled horizontally and continuously only by engaging the respective divided units with the engaging grooves formed to a housing unit.

What is claimed is:

1. A food and drink circulating conveyor provided with opening and closing doors and disposed along an eating and drinking counter for conveying and supplying food and drink, comprising:

a tunnel unit which has at least one side formed as a curved portion having a prescribed radius of curvature and disposed on the conveyer passage, opening and closing doors having a radius of curvature approximating that of said prescribed radius of curved portion, slide rails, composed of an outside guide and an inside guide for guiding the opening and closing doors in an up and down direction, wherein the outside guide terminates short of an upper position of said tunnel unit, and wherein supporting members are mounted on base rails which are divided into a plurality of units, each unit having a prescribed length which are sequentially engaged with engaging grooves formed on a housing unit, and the opening and closing doors are assembled as a plurality of units on the supporting members to thereby form said tunnel unit, and wherein when the opening and closing doors are moved to the upper position of said tunnel unit past the outside guide, said doors can be removed from the tunnel unit.

2. A food and drink circulating conveyer provided with opening and closing doors according to claim 1, wherein removable lid members having a radius or curvature approximating that of the curved portion are placed on the upper position of said tunnel unit, and the inside surfaces of said lid members serve as external guides for guiding the opening and closing doors.

3. A food and drink circulating conveyer provided with opening and closing doors according to claim 2, wherein a grip projecting toward the outside of said tunnel unit is disposed on each of the opening and closing doors and engages with each of the lid members to thereby prevent the opening and closing doors from sliding beyond a predetermined point.

4. A food and drink circulating conveyer provided with opening and closing doors according to claim 1, wherein a thin polyolefin layer is formed on each of the portions of the opening and closing doors which are in contact with the slide rails.

* * * * *